United States Patent [19]

Cotta

[11] Patent Number: 4,739,915

[45] Date of Patent: Apr. 26, 1988

[54] SIMPLIFIED SELF-CONTAINED INTERNAL COMBUSTION FASTENER DRIVING TOOL

[75] Inventor: Gilbert A. Cotta, Cincinnati, Ohio

[73] Assignee: Senco Products, Inc., Cincinnati, Ohio

[21] Appl. No.: 881,337

[22] Filed: Jul. 2, 1986

[51] Int. Cl.[4] ..... B25C 1/08

[52] U.S. Cl. ..... 227/10; 123/465 C

[58] Field of Search ..... 227/9, 10, 8; 123/465 C, 48 A; 60/632, 633

[56] References Cited

FOREIGN PATENT DOCUMENTS 0056990 1/1982 European Pat. Off. .

0056989 1/1982 European Pat. Off. .

*Primary Examiner*—E. R. Kazenske

*Assistant Examiner*—James L. Wolfe

*Attorney, Agent, or Firm*—Frost & Jacobs

[57] ABSTRACT

A fastener driving tool powered by internal combustion of an oxidizer/fuel mixture. The tool body contains a cylinder provided with a piston/driver assembly. The cylinder is surrounded by and connected to a return air chamber. A combustion chamber, provided with an ignition device, is located at the upper end of the cylinder. A positive trigger-actuated cam system, upon actuation of the trigger, is configured to open a fuel valve to introduce a measured amount of gaseous fuel from a source thereof into the combustion chamber; to thereafter open an oxidizer valve to introduce a measured quantity of gaseous oxidizer from a source thereof into the combustion chamber; to next actuate the ignition device to combust the oxidizer/fuel mixture causing the piston/driver assembly to drive a fastener and to fill the return air chamber with air under pressure; and finally to actuate a pilot valve operating an exhaust valve eliminating products of combustion from the combustion chamber, enabling air from the return air chamber to return the piston/driver assembly to its normal position. The sources of gaseous fuel and gaseous oxidizer comprise canisters of each replaceably mounted within the tool body.

23 Claims, 5 Drawing Sheets

SIMPLIFIED SELF-CONTAINED INTERNAL COMBUSTION FASTENER DRIVING TOOL

REFERENCE TO RELATED APPLICATIONS

The present invention is related to co-pending application Ser. No. 06/881,339 filed July 2, 1986, in the name of the same inventor and entitled SELF-CONTAINED INTERNAL COMBUSTION FASTENER DRIVING TOOL; and to co-pending application Ser. No. 06/881,343, filed July 2, 1986 in the name of the same inventor and entitled CAM-CONTROLLED SELF-CONTAINED INTERNAL COMBUSTION FASTENER DRIVING TOOL.

TECHNICAL FIELD

The invention relates to an internal combustion fastener driving tool, and more particularly to such a tool having a positive-control cam system with simple two-way valves to actuate the full cycle of the tool by actuation of a trigger, and being self contained, having replaceable canisters of gaseous fuel and oxidizer mounted therein.

BACKGROUND ART

The majority of fastener driving tools in use today are pneumatically actuated tools. Pneumatic fastener driving tools have been developed to a high degree of sophistication and efficiency, but require a source of air under pressure and are literally tied thereto by hose means. Under some circumstances, particularly in the field, a source of air under pressure is not normally present and is expensive and sometimes difficult to provide.

Prior art workers have also developed a number of electro-mechanical fastener driving tools, usually incorporating one or more flywheels with one or more electric motors therefor. Such tools require a source of electrical current which is normally present at the job site. However, this type of tool is also quite literally "tied" to a power source.

Under certain circumstances, it is desirable to utilize a completely self-contained fastener driving tool, not requiring attachment to a source of air under pressure or a source of electrical current. To this end, prior art workers have devised self-contained fastener driving tools powered by internal combustion of a gaseous fuel-air mixture. It is to this type of tool that the present invention is directed.

Exemplary prior art internal combustion fastener driving tools are taught, for example, in U.S. Pat. Nos. 2,898,893; 3,042,008; 3,213,607; 3,850,359; 4,075,850; 4,200,213; 4,218,888; 4,403,722; 4,415,110; and European Patent Applications Nos. 0 056 989; and 0 056 990. While such tools function well, they are usually large, complex, heavy and awkward to use.

The fastener driving tool of the present invention comprises a self-contained internal combustion tool which is compact, easy to manipulate and unusually simple in construction. The fastener driving tool is highly efficient, operating on a moderate compression ratio to convert most of the fuel energy into useful work. The tool carries a replaceable canister of gaseous fuel and a replaceable canister of oxidizer. This eliminates the necessity for a combustion air chamber and its attendant passages and valving, as well as a second cylinder and piston acting as a compressor during the tool cycle to replenish air under pressure in a combustion air chamber. As a result, the tool has a single cylinder, provided with a piston/driver which, during a tool cycle, drives a fastener into a workpiece and fills a return air chamber (to which the cylinder is connected) with air under pressure.

The fastener driving tool is provided with a positive, trigger-actuated cam system which sequences the tool through its cycle, upon actuation of the trigger. The cam system operates a series of two-way valves and an ignition device.

DISCLOSURE OF THE INVENTION

According to the invention there is provided a fastener driving tool which is self-contained and uses internal combustion of a gaseous oxidizer-fuel as its driving force. The tool comprises a tool housing or body, including a handle portion. A guide body is mounted at the lower end of the housing. A magazine, containing a plurality of fasteners, is supported at one end by the guide body and at its other end by the handle portion.

The tool body contains a single cylinder. The cylinder is surrounded and connected to a return air chamber, and contains a piston/driver assembly for driving a fastener during the tool cycle. The upper end of the cylinder is provided with a closure defining a combustion chamber having an ignition means. The piston of the piston/driver assembly, when in its normal unactuated position, constitutes the bottom of the combustion chamber.

The tool cycle is controlled by a positive, trigger-actuated cam system. Upon actuation of the trigger, the cam system is configured to first open a fuel valve to introduce a measured amount of gaseous fuel from the canister thereof into the combustion chamber. Thereafter, the cam system opens an oxidizer valve to introduce a measured quantity of oxidizer from the canister thereof into the combustion chamber. The cam system next actuates the ignition device to combust the oxidizer/fuel mixture. This combustion causes the piston/-driver assembly to drive a fastener and to fill the return air chamber with air under pressure. Finally, the cam system is configured to actuate a control or pilot valve which admits some of the air under pressure from the return air chamber to an exhaust valve, opening the exhaust valve to eliminate the spent products of combustion from the combustion chamber. This, in turn, enables the piston/driver assembly to be shifted to its normal position by air under pressure from the return air chamber. Thereafter, the tool is ready for its next actuation and driving cycle. As will be pointed out hereinafter, the same sequence control can be achieved through the use of a single trigger-actuated cam, rather than a system of cams.

DETAILED DESCRIPTION OF THE INVENTION

In all of the Figures, like parts have been given like index numerals. Reference is first made to FIGS. 1–4. In these figures, the tool of the present invention is generally indicated at 1. The tool 1 comprises a main housing 2 having a handle 3. A guide body 4 is affixed to the lower end of the main housing. A magazine for fasteners is illustrated at 5, being affixed at its forward end to the guide body 4 and at its rearward end to the handle 3.

Figure 4:
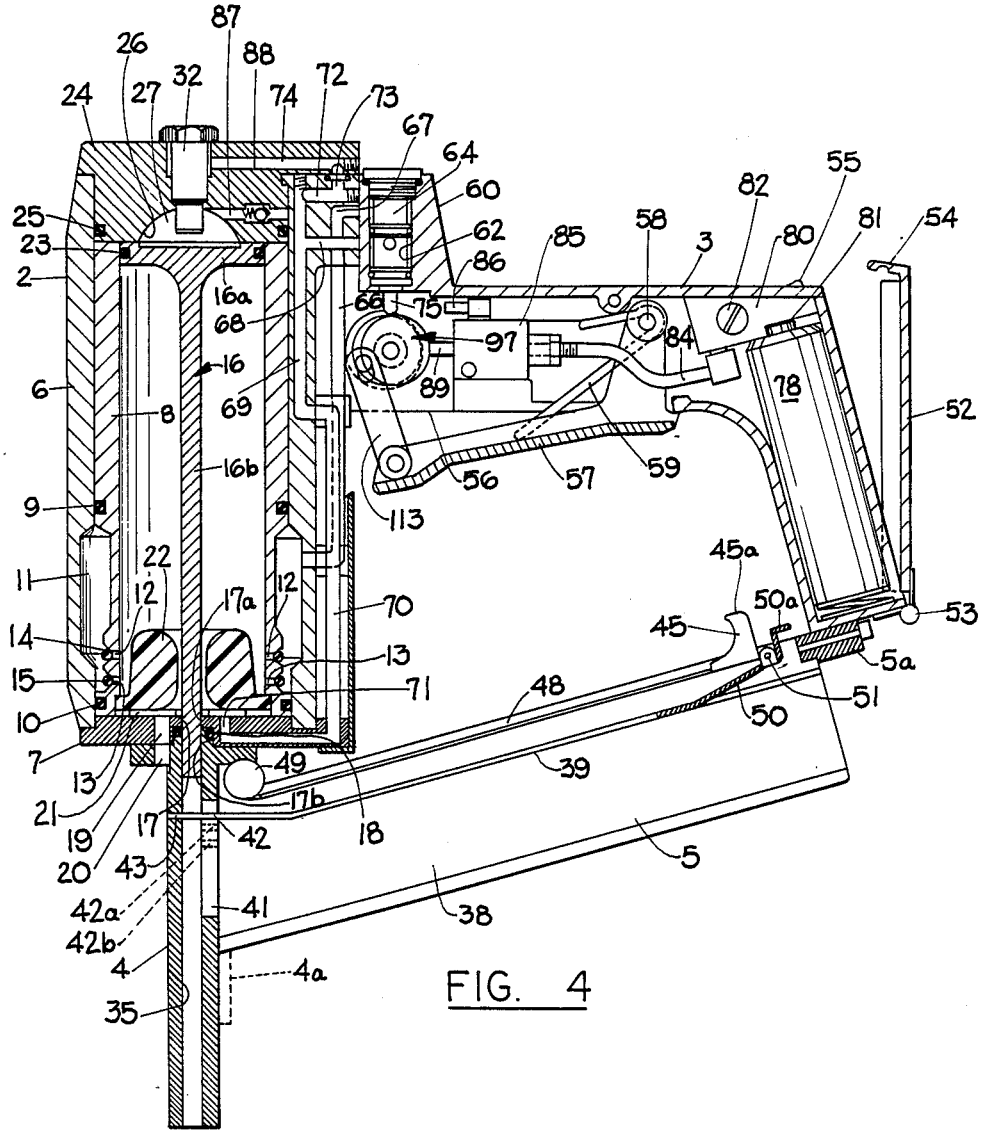
FIG. 4 is a cross-sectional elevational view of the tool of FIG. 1.

Turning to FIG. 4, the housing 2 comprises a cylindrical member 6. The lower end of cylindrical member 6 is closed by a bottom cap 7, removably affixed thereto by any suitable means such as bolts or the like (not shown). The cylindrical housing member 6 contains a cylinder 8. The cylinder 8 carries on its exterior surface O-rings 9 and 10 forming a fluid tight seal with the inside surface of cylindrical housing member 6. The inside surface of the cylindrical housing member 6 and the exterior surface of cylinder 8 are so configured as to form an annular return air chamber 11 therebetween, the purpose of which will be apparent hereinafter. The bottom cap 7 also closes the bottom end of cylinder 8.

The cylinder 8 is provided with two annular rows of perforations 12 and 13 communicating with the return air chamber. Each of the annular rows of perforations 12 and 13 may, when required be surrounded by an O-ring (as at 14 and 15) serving as one-wa valves from cylinder 8 to return air chamber 11.

The cylinder 8 contains a piston/driver assembly, generally indicated at 16, and comprising a piston portion 16*a* and an elongated driver portion 16*b*. The bottom cap 7 has a bore 17, having a first portion 17*a* of a diameter to just nicely receive the driver portion 16*b* of piston/driver assembly 16, and a portion 17*b* of larger diameter. The larger diameter portion 17*b* of bore 17 receives the end of guide body 4 together with O-ring 18. The O-ring 18 makes a fluid tight seal between guide body 4 and lower cap 7, as well as between the guide body 4, the lower cap 7 and the driver portion 16*b* of piston/driver assembly 16. Bottom cap 7 is provided with at least one bore 19 and guide body 4 is provided with at least one matching, coaxial bore 20, which bores are normally closed by a flapper valve 21. The purpose of bores 19 and 20 and flapper valve 21 will be apparent hereinafter. It would be within the scope of the present invention to make the bottom cap 7 and the guide body 4 as a single part.

A resilient bumper 22, adapted to absorb the energy of the piston/driver assembly 16 at the bottom of its stroke is located at the bottom of cylinder 8. It will be noted that the piston portion 16*a* of piston/driver assembly 16 supports an O-ring 23, making a fluid tight seal with the inside surface of cylinder 8. In FIG. 4, the piston/driver assembly 16 is shown in its uppermost position, abutting a cap 24 which closes the upper end of cylinder 8 and the upper end of body member 6. The cap 24 carries an O-ring 25 which sealingly engages in fluid tight fashion the inside surface of body member 6.

The bottom surface of cap 24 has a dome-like depression 26 formed therein, the domed depression 26, together with the piston portion 16*a* of piston/driver assembly 16 (in its uppermost position) defining a combustion chamber 27.

Figure 3:
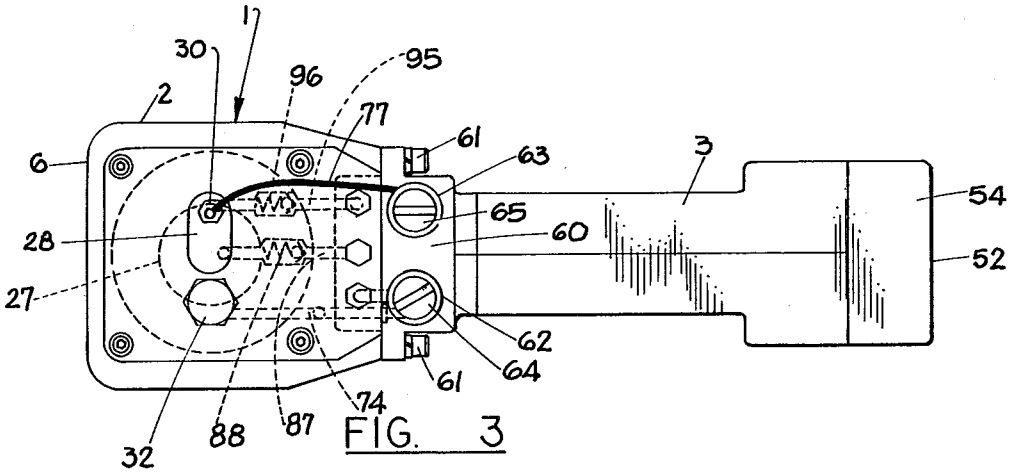
FIG. 3 is a plan view of the tool of FIG. 1.
Figure 2:
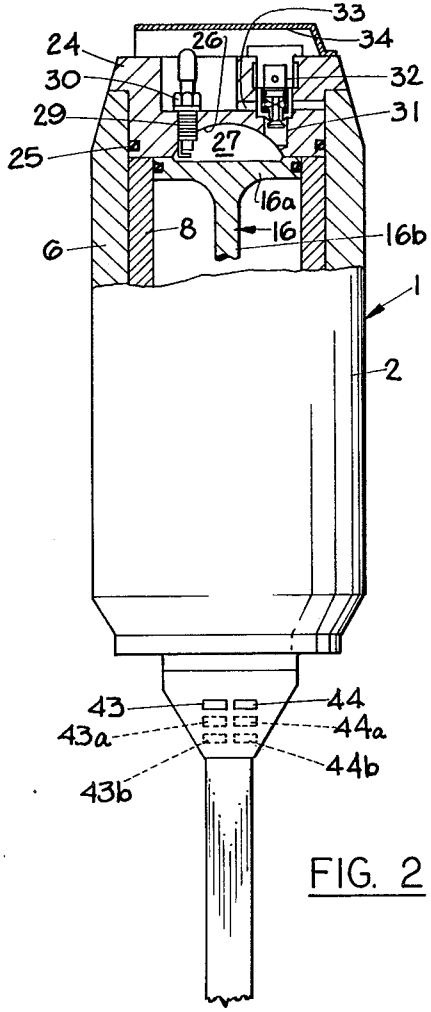
FIG. 2 is a front elevational view of the tool of FIG. 1, partly in cross section to reveal the spark plug, the exhaust valve and the combustion chamber.

Referring particularly to FIGS. 2, 3 and 4, the upper surface of cap 24 has a depression 28 formed therein. The bottom of depression 28 communicates with combustion chamber 27 through a bore 29. An ignition device 30, in the form of a spark plug, is threadedly engaged in bore 29 and extends into combustion chamber 27. The cap 24 has a second vertical bore 31 formed therein, in which is mounted a two-way, normally closed, pilot actuated exhaust valve 32. As can most clearly be seen in FIG. 2, the inlet of exhaust valve 32 communicates with combustion chamber 27. The outlet of exhaust valve 32 communicates with a transverse bore 33 formed in cap 24 and leading to cap depression 28. In this way, exhaust valve 32 can exhaust combustion chamber 27 to atmosphere as will be described hereinafter. An exhaust shield 34 (FIG. 2) can be affixed to the upper surface of cap 24 by any appropriate means.

The guide body 4 has a longitudinal slot or bore 35 constituting a drive track for the driver portion 16*b* of the piston/driver assembly 16. As indicated above, the tool of the present invention may be used to drive any appropriate type of fastening means including studs, nails, staples and the like. For purposes of an exemplary showing, the tool is illustrated in an embodiment suitable for driving studs. It will be understood that the configuration of the driver portion 16*b* of piston/driver assembly 16, the configuration of drive track 35 and the nature of magazine 5 can vary, depending upon the type of fastener to be driven by the tool 1.

Figure 5:
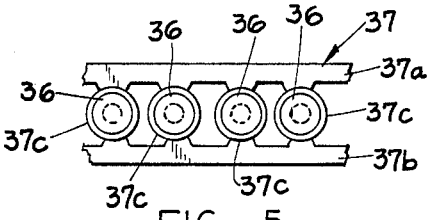
FIG. 5 is a fragmentary plan view of an exemplary strip of fasteners in the form of studs.
Figure 6:
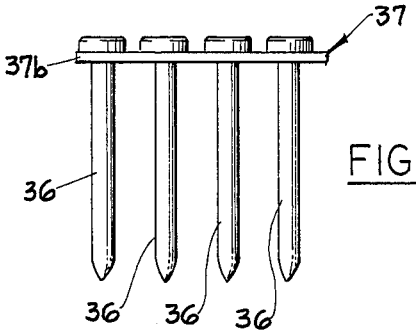
FIG. 6 is a fragmentary elevational view of the strip of fasteners of FIG. 5.

Reference is now made to FIGS. 5 and 6. The exemplary fasteners are illustrated in FIGS. 5 and 6 as headed studs 36. The studs are supported by an elongated plastic strip generally indicated at 37. As can best be ascertained from FIG. 5, the plastic strip 37 is an integral, one-piece structure comprising two elongated ribbon-like members 37*a* and 37*b* joined together by a plurality of circular washer-like members 37*c*. The washer-like members 37*c* have central perforations sized to snugly receive the shanks of studs 36. When each stud is driven, in its turn, by the driver portion 16*b* of piston/driver assembly 16, its respective washer-like structure 37*c* will break away from ribbon-like members 37*a* and 37*b* and will remain with the stud.

Figure 7:
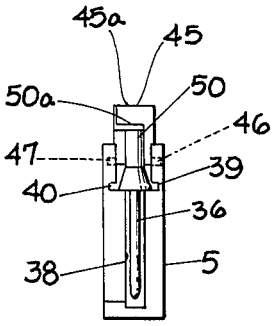
FIG. 7 is a simplified rear elevational view of the tool magazine.

Reference is now made to FIGS. 4 and 7. The magazine 5 has a central opening 38 extending longitudinally thereof and accommodating the studs 36. The opening 38 is flanked on each side by shallow transverse slots 39 and 40, also extending longitudinally of magazine 5. The ribbon-like portions 37*a* and 37*b* of the strip 37 are slidably received in the slots 39 and 40, respectively. The rearward wall of the guide body 4 has a slot 41 formed therein corresponding to the opening 38 of magazine 5. The guide body slot 41 is intersected by a pair of transverse slots, one of which is shown at 42. These slots correspond to magazine slots 39 and 40, and similarly cooperate with the ribbon-like portions 37*a* and 37*b* of strip 37. The forward wall of guide body 4 has a pair of transverse slots 43 and 44 formed therein (see also FIG. 2). The slots 43 and 44 are larger in size than ribbon-like strip portions 37*a* and 37*b* and permit scrap portions of strip elements 37*a* and 37*b*, from which the studs 36 and washer-like elements 37*c* have been removed, to exit the tool 1.

From the above description it will be apparent that the studs 36 are supported by strip 37, and that the strip 37, itself, is slidably supported within magazine 5. With the studs depending downwardly in opening 38 and strip portions 37*a* and 37*b* slidably engaged in magazine slots 39 and 40, the guide body rear wall slots (one of which is shown at 42) and the guide body front wall slots 43 and 44. The forwardmost stud 36 of the strip enters the drive track 35 of guide body 4 via slot 41 and is properly located under the driver portion 16*b* of piston/driver assembly 16 by its respective washer 37*c*. Once the stud and washer assembly has been driven by the driver portion 16*b* of piston/driver assembly 16, the strip 37 will advance in the magazine 5 and guide body 4 to locate the next forwardmost stud 36 in guide body drive track 35, as soon as the piston/driver assembly 16 has returned to its normal position shown in FIG. 4.

Any appropriate means can be employed to advance the strip 37 through magazine 5 and to constantly urge the forwardmost stud 36 of the strip 37 into the guide body drive track 35. For purposes of an exemplary showing, a feeder shoe 45 is illustrated in FIGS. 4 and 7. The feeder shoe 45 is slidably mounted in transverse slots 46 and 47 in the magazine (see FIG. 7). The feeder shoe 45 is operatively attached to a ribbon-like spring 48 located in an appropriate socket 49 at the forward end of magazine 5. In this way, the feeder shoe 45 is constantly urged forwardly in the magazine 5, and as a result, constantly urges the stud-supporting strip 37 forwardly. The feeder shoe 45 has a handle portion 45*a* by which it may be easily manually retracted during the magazine loading operation. The feeder shoe 45 also pivotally mounts a lug 50. A spring (not shown) is mounted about pivot pin 51 with one leg of the spring abutting feeder shoe 45, and the other leg abutting the lug 50 to maintain the lug 50 in its downward position as shown in FIG. 4. In its downward position, the lug 50 abuts the rearward end of strip 37, enabling the feeder shoe (under the influence of spring 48) to urge the strip 37 forwardly. The lug 50 has an integral, upstanding handle 50*a* by which it can be pivoted upwardly toward the feeder shoe 45, and out of the way during loading of the magazine 5. The handle 3 of tool 1 is hollow. At its rearward end, the handle 3 is provided with a closure or door 52. The door 52 is hinged as at 53. The upper end of the door is provided with a notched tine 54 which cooperates with a small lug 55 on the upper surface of the handle 3, to maintain the door 52 in closed position.

The lower part of the grip portion of handle 3 is open, as at 56. This opening provides room for a manual trigger 57 which is pivotally mounted within handle 3, by pivot pin 58. The trigger 57 normally rests in its downward or most extended position, as shown in FIG. 4, by virtue of a biasing spring 59.

The upper part of the forward end of handle 3 has an extension 60. The forward end of the handle 3 is affixed to housing 2 by a series of bolts, two of which are shown at 61 in FIG. 3. The handle extension portion 60 contains a pair of bores 62 and 63. The bore 62 houses a two-way, normally closed pilot valve 64. The bore 63 houses a conventional piezoelectric device 65.

Referring to FIGS. 3 and 4, bore 62 housing two-way pilot valve 64 is connected to the return air chamber 11 by a conduit 66 and a passage 67 in housing 2. This is most clearly shown in FIG. 4. The outlet, of pilot valve 64 is connected by passages 68 and 69 in housing 2, conduit 70 and passage 71 in bottom cap 7 to cylinder 8 beneath piston/driver assembly 16 and by way of normally closed reed valve 21. The pilot valve outlet is also connected by passages 68, 72 and 73 in housing 2 to passage 74 in cap 24 leading to the actuator of exhaust valve 32. Two-way pilot valve 64 is provided with a plunger-like actuator 75, which will be further described hereinafter.

Figure 11:
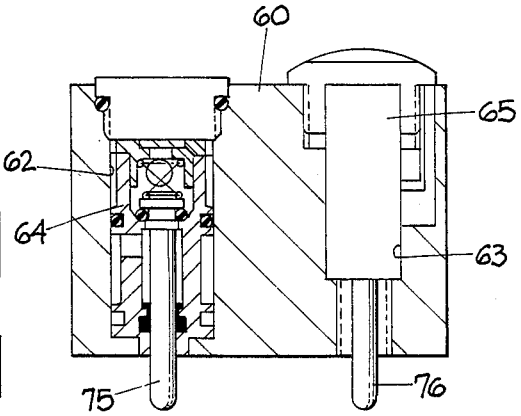
FIG. 11 is a cross-sectional view taken along section line 11—11 of FIG. 1.

The piezoelectric device 65 has a similar actuator 76 (see FIG. 11), about which more will be stated hereafter. The piezoelectric device 65 is connected by wire means 77 to the spark plug 30 (see FIG. 3).

Figure 1:
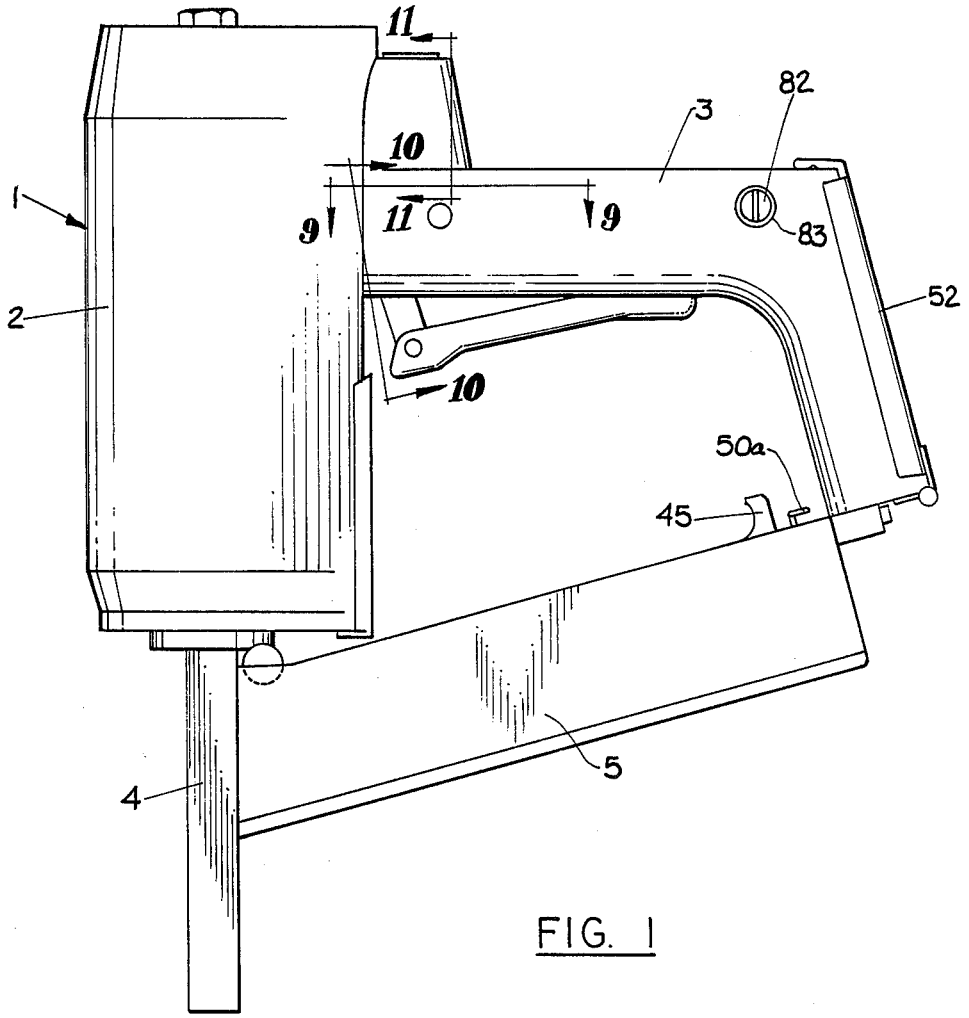
FIG. 1 is a side elevational view of the self-contained internal combustion fastener driving tool of the present invention.
Figure 8:
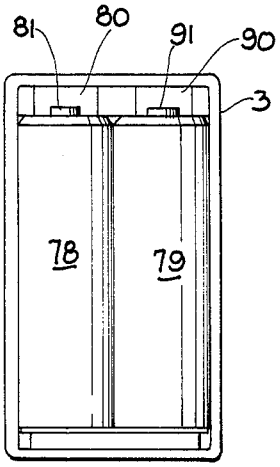
FIG. 8 is a simplified rear elevation of the handle of the tool with the door removed.

Reference is now made to FIGS. 1, 4 and 8. The door 52 at the rearward end of handle 3 enables the placement within the handle of a canister 78 containing a gaseous oxidizer such as oxygen or nitrogen oxide and a canister 79 containing a gaseous fuel such as propane or the like. The canister 78 is adapted to mate with a pressure regulating needle valve 80 located within handle 3 (see FIGS. 4 and 8). This mating of canister 78 with needle valve 80 opens a spring loaded valve 81, constituting a part of canister 78. Needle valve 80 has an adjustment screw 82, accessible through a perforation 83 in handle 3 (see FIG. 1). The pressure regulating needle valve 80 is connected by a conduit 84 to a normally closed, two-way oxidizer valve 85, mounted within handle 3. The outlet of valve 85 is connected by conduit 86 (fragmentarily shown in FIG. 4) to the passage 87 (see FIGS. 3 and 4) containing one-way check valve 88, and leading to combustion chamber 27. The two-way gaseous oxidizer valve 85 is provided with a plunger-like actuator 89, similar to the actuators 75 and 76 of pilot valve 64 and piezoelectric device 65.

Fuel canister 79 mates with a pressure regulating needle valve 90 located within handle 3 (see FIG. 8). This mating of canister 79 with needle valve 90 opens a spring loaded valve 91 constituting part of canister 79. Needle valve 90 has an adjustment screw (not shown) similar to adjustment screw 82 of needle valve 80 and accessible through a perforation (not shown) in handle 3 similar to perforation 83 but on the opposite side of handle 3.

Figure 9:
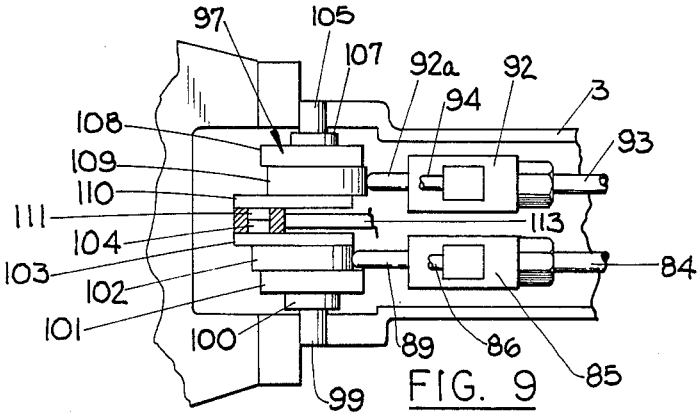
FIG. 9 is a fragmentary, cross-sectional, plan view taken along section line 9—9 of FIG. 1.

Referring to FIG. 9, a normally closed, two-way fuel valve 92 is located within handle 3, alongside gaseous oxidizer valve 85. The inlet of fuel valve 92 is connected by conduit 93 to needle valve 90. The outlet of fuel valve 92 is connected by conduit 94 to passage 95 in cap 24 leading to combustion chamber 27 and having a one-way check valve 96 therein. Fuel valve 92 is provided with a plunger-like actuator 92*a*.

Figure 10:
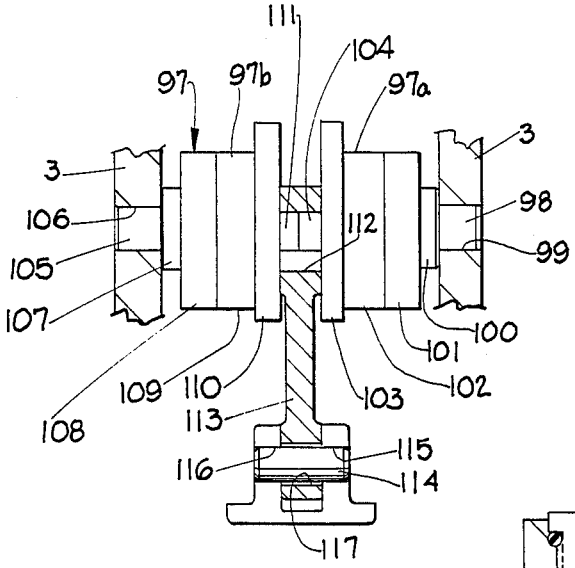
FIG. 10 is a fragmentary, cross-sectional view taken along section line 10—10 of FIG. 1, with the link also shown in cross section.

To complete the structure of tool 1, a trigger actuated control cam system is provided and is generally indicated at 97 in FIGS. 4, 9 and 10.

As is best seen in FIG. 10, the cam system 97 is made up of two parts 97*a* and 97*b*. The part 97*a* comprises a shaft portion 98 rotatively mounted in a perforation 99 in handle 3. The shaft portion 98 is followed by a spacer portion 100 and two cam elements 101 and 102. The elements 101 and 102 are followed by another spacer member 103 having an offset pin portion 104. The cam system portion 97*b*, in similar fashion has a shaft portion 105 rotatively mounted in a perforation 106 in handle 3. The pin portion 105 is followed by a spacer portion 107, a pair of cam elements 108 and 109 and a second spacer portion 110 having a pin portion 111.

When the cam system 97 is assembled, its pin portions 104 and 111 are located in a perforation 112 in a link 113. Pin portions 104 and 111 abut each other and engage each other such that they will not rotate relative to each other. When assembled, shaft portions 98 and 105 of cam system 97 are coaxial. Similarly, pin portions 104 and 111 are coaxial. The axes of these two shaft and pin sets 98–105 and 104–111 are parallel and spaced from each other. It will be understood that the cam system 97 could be made as a single, integral, one-piece part. Under such circumstances, the link 113 would be made in more than one part to enable its attachment to cam system 97.

The top end of link 113 being pivotally attached to cam system 97, the bottom end of link 113 is similarly pivotally attached to trigger 57. To this end, a pivot pin 114 passes through perforations 115 and 116 in trigger 86 and a perforation 117 at the bottom end of link 113. It will be immediately apparent from FIGS. 4, 9 and 10 that if trigger 57 is depressed against the action of trigger biasing spring 59, and then is released, the trigger link 113 will cause one complete revolution of cam system 97.

As will be apparent from FIG. 9, the plunger-like actuator 89 of gaseous oxidizer valve 85 contacts and is operated by cam element 102. Similarly, plunger-like actuator 92*a* of gaseous fuel valve 92 contacts and is operated by cam element 109. As is shown in FIG. 4, plunger-like actuator 75 of pilot valve 65 contacts and is operated by cam element 101. In a similar fashion, as can be ascertained from a comparison of FIGS. 10 and 11, the plunger-like actuator 76 of piezoelectric device 65 contacts and is operated by cam element 108. It will be understood that cam elements 101, 102, 108 and 109 are so configured as to operate their respective plunger-like actuators 75, 89, 76 and 92*a* in the proper sequence. It will further be apparent that trigger 57 be fully depressed and fully released to cause the tool 1 to operate through one complete cycle.

TOOL OPERATION

The tool 1 of the present invention having been described in detail, its operation can now be set forth as follows. Reference is made to FIG. 4, wherein the tool and its various elements are shown in their normal, unactuated conditions.

For its initial use, or if the tool has not been used for some time, air pressure in the return air chamber 11 will be at atmospheric level. Under these circumstances, before a fastener strip is loaded into the magazine, the needle valves 80 and 90 are set to an intermediate position. The tool is then ready to be primed. This can be done by actuating the tool through the trigger 57 several times, whereby the return air chamber is primed with compressed air at the operating level.

Once the tool is primed and in operating condition, the feeder shoe 45 is grasped by its handle portion 45*a* and pulled rearwardly with respect to magazine 5. The lug 50 is shifted out of the way by means of its handle portion 50*a* and a strip 37 carrying a plurality of studs 36 is loaded into the magazine 5 with the forwardmost stud being located in the drive track 35 of guide body 4. The lug 50 and feeder shoe 45 are then released.

It will be understood that a gaseous oxidizer canister 78 and a gaseous fuel canister 79 have been located in the handle and are appropriately connected to needle valves 80 and 90 respectively. The needle valves are properly adjusted by means of their adjustment screws, if required.

When it is desired to actuate tool 1, the guide body 4 is located against the workpiece at a position where it is desired to drive a stud, and the manual trigger 57 is actuated by the operator. As a result of the trigger actuation, a tool cycle is initiated, including the following sequential events.

Actuating manual trigger 57 results, through the action of the link 113 in rotation of the cam system 97. Cam elements 101, 102, 108 and 109 are so configured that cam element 109 first operates the actuator 92*a* of two-way fuel valve 92 introducing a metered amount of gaseous fuel into combustion chamber 27 through check valve 96. The amount of fuel introduced depends upon the setting of needle valve 90. The piston/driver assembly 16 shifts slightly downwardly due to the pressure of the gaseous fuel within combustion chamber 27. When the cooperation of cam element 109 and actuator 92*a* begins to close fuel valve 92, the next operation of the cycle is initiated.

Continued rotation of the cam system 97 initiates the second operation of the cycle wherein cam element 102 operates actuator 89 of oxidizer valve 85, introducing a metered amount of oxidizer from canister 78 into the combustion chamber 27 through one-way valve 88. As a result of this operation, the proper mixture of oxidizer and fuel is present in combustion chamber 27. The oxidizer/fuel mixture is under moderate compression ratio (for example 2:1 and preferably about 1:3 or more) assuring the most complete burning and the most efficient use of the fuel. The piston/driver assembly 16, at this point, is pressed against the head of the forwardmost stud 36 located in guide body drive track 35. The strip 37, supporting studs 36, is designed to be strong enough to withstand the loading due to the pressure of the oxidizer/fuel mixture over the piston/driver assembly 16. As the cam system 97 continues to rotate and the interaction of cam element 102 and actuator 89 begins to close oxidizer valve 85, the next operation is initiated.

The third operation of the cycle involves operation of actuator 76 of piezoelectric device 65 by cam element 108 When the crystal of the piezoelectric device 65 is struck or fully compressed, a spark of high voltage is generated between the electrodes of spark plug 30 in combustion chamber 27. As a result, the oxidizer/fuel mixture ignites, generating a rapid expansion of the combusted gases which increases the pressure on piston/driver assembly 16. At this point, manual trigger 57 is completely actuated or depressed.

The piston/driver assembly 16 shifts downwardly as viewed in FIG. 4, shearing the washer 36*c* (surrounding the forwardmost stud of the strip) from strip 37 and driving the forwardmost stud 36 into the work piece (not shown). While the piston/driver assembly 16 shifts downwardly, air beneath the piston/driver assembly 16 is compressed into return air chamber 11 through ports 12 and 13. That energy of piston/driver assembly 16, not expended in driving the stud 36, is absorbed by the resilient bumper 22.

The above described three operations of the tool cycle complete the drive part of the cycle. The return part of the cycle begins as manual trigger 57 begins to return toward its normal, unactuated position, under the influence of spring 59.

At this point, the fourth operation of the cycle begins. The fourth operation of the cycle entails operation of actuator 75 of pilot valve 64 by cam element 101, as the cam system 97 continues its rotation. When two-way pilot valve 64 is opened, a part of the air under pressure from return air chamber 11 is used to actuate or open exhaust valve 32. This enables the products of combustion from combustion chamber 27 to be exhausted to atmosphere. While the combustion chamber exhausted, the remainder of the return air from return air chamber 11 is channeled back beneath the piston/driver assembly 16 through passages 68 and 69, conduit 70 and passage 71, returning the piston/driver assembly 16 to its normal or prefire position. Flapper valves 21 beneath resilient bumper 22 open to permit some fresh air to enter beneath the piston/driver assembly 16 until it is balanced to atmospheric level.

Manual trigger 57 returns to its normal, unactuated position. Feeder shoe 45 and its lug 50 assure that the next forwardmost stud 36 of strip 37 is located within drive track 35 of guide body 4 as soon as piston/driver assembly 16 returns to its normal retracted position. As a result, the tool cycle is complete and the tool is ready for another cycle.

Figure 12:
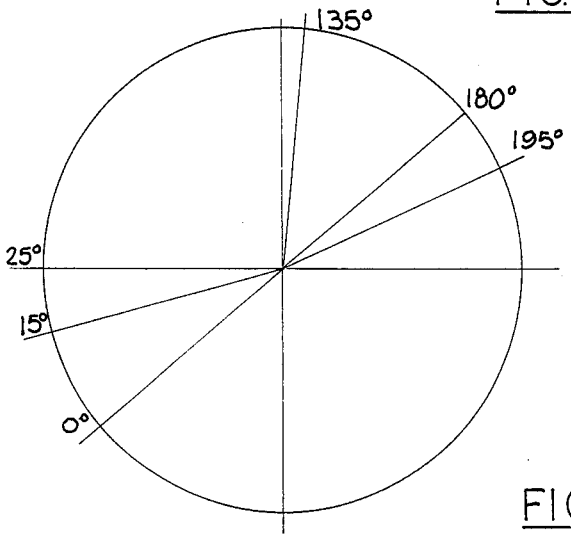
FIG. 12 is a diagrammatic representation of the cam system operating positions.

FIG. 12 is a diagrammatic representation of the various operation initiation points of cam system 120. At the 0° mark the manual trigger 57 is at rest in its normal position. When the operator actuates trigger 57, causing rotation of cam system 97, cam element 109 will operate the actuator 92*a* of two-way fuel valve 92 after about 15° of rotation of cam system 97. At about 25° of rotation, cam element 102 will operate actuator 89 of two-way oxidizer valve 85. At about 135° of rotation, cam element 108 will operate actuator 76 of piezoelectric device 65. At 180° the trigger is fully depressed.

When the trigger 57 is released and begins to return to its normal, unactuated condition under the influence of spring 59, cam element 101 will operate actuator 75 of pilot valve 64 when the cam system 97 has rotated about 195°. Thereafter, the cam system 97 will return to its normal, unactuated position indicated at 0°. It will be apparent to one skilled in the art that by properly arranging two-way fuel valve 92, two-way oxidizer valve 85, piezoelectric device 65 and two-way pilot valve 64 thereabout, a single cam element could be substituted for cam elements 101, 102, 108 and 109. The single cam element could be rotatively mounted in the handle 3 and caused to rotate 360° by a manual trigger and lever similar to trigger 57 and lever 113. The single cam element would operate each of actuators 92*a*, 89, 76 and 75 in proper timed sequence.

The tool 1 could be provided with various types of safety devices, as is well known in the art. For example, manual trigger 57 could be disabled until a workpiece responsive trip (not shown), operatively connected thereto, is pressed against the workpiece to be nailed. Alternatively, the workpiece responsive trip could be employed to close a normally open switch in the spark plug-piezoelectric device circuit. Such arrangements are well known in the art and do not constitute a part of the present invention.

It will be understood that the tool of the present invention may be held in any orientation during use. Thus, words such as "upper", "lower", "upwardly", "downwardly", "vertical", and the like are used in the above description and the claims in conjunction with the drawings for purposes of clarity, and are not intended to be limiting.

Figure 13:
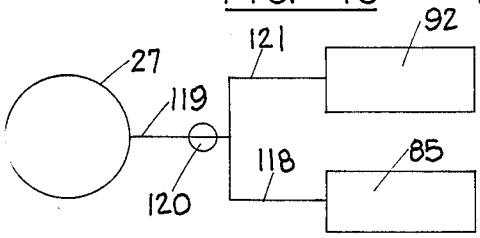
FIG. 13 is a diagrammatic representation of the combustion chamber, the check valve and the fuel and oxidizer valves in a second embodiment of the tool.

Modifications may be made in the invention without departing from the spirit of it. For example, the tool 1 could be simplified by connecting the outlets of fuel valve 92 and oxidizer valve 85 to a single passage provided with a check valve and leading to the combustion chamber. This is diagrammatically illustrated in FIG. 13. The outlet of oxidizer valve 85 is connected by conduit 118 to a passage 119 containing check valve 120 and leading to combustion chamber 27. In similar fashion the outlet of fuel valve 92 is connected to passage 119 ahead of check valve 120 by conduit 121.

The power output of the tool 1 of the present invention can be varied, by changing the size of combustion chamber 27. It will be remembered that, when fuel and combustion air are introduced into the combustion chamber 27 during the tool cycle, the piston/driver assembly 16 shifts slightly downwardly until the free end of the driver 16*b* contacts the head of the forwardmost stud 36 in drive track 35 of guide body 4. Thus, the size of combustion chamber 27 is determined, in part, by the position of the piston portion 16*a* of piston/driver asesmbly 16. As a consequence, if the forwardmost stud 36 located in drive track 35 of guide body 4 were slightly lowered, the piston portion 16*a* of piston/driver assembly 16 would lower an equivalent amount, enlarging combustion chamber 27 and increasing the amount of oxidizer/fuel mixture it can contain. In this way, the power of the tool would be increased. Lowering the fowardmost stud in the drive track 35 of guide body 4 can be accomplished in several ways. First of all, a different guide body and magazine could be substituted, if a power increase is desired. Another way would be to lower the entire magazine 5 with respect to the remainder of tool 1. This could be accomplished by making the attachment of the forward end of magazine 5 to guide body 4 an adjustable one. For example, the forward end of magazine 5 could ride in a pair of tracks (one of which is shown in broken lines at 4*a* in FIG. 4). Preferably means (not shown) are provided to lock the forward end of magazine 5 in selected adjusted positions with respect to the tracks. To this end, the opening 68 in the rearward wall of guide body 4 could be so sized as to enable the passage of studs therethrough in any of the preselected positions of magazine 5. Similarly, additional slots equivalent to slot 69 should be provided at selected positions in the guide body, such additional slots are shown in FIG. 4 in broken lines at 69*a* and 69*b*. Additional slots equivalent to slots 43 and 44 should be provided in the forward wall of guide body 4. Such additional slots are indicated in broken lines in FIG. 2 at 43*a*, 43*b*, 44*a* and 44*b*. Finally, the bracket means 5*a* (see FIG. 4) by which the rearward end of magazine 5 is attached to handle 3 must be made adjustable, as well.

When the size of combustion chamber 27 is enlarged in the manner just described, it will be necessary to adjust the pressure regulating screw 82 of needle valve 80 and the regulating screw (not shown) of needle valve 90, to appropriately change the fuel/air mixture. To this end, the handle 3 could be provided with indicia (not shown) indicating the proper settings for valves 80 and 90.

What I claim is:

1. An internal combustion fastener driving tool comprising a housing, a cylinder located within said housing, said cylinder having lower and upper ends, a lower cap on said housing closing the lower end of said cylinder, an upper cap on said housing closing the upper end of said cylinder, a piston/driver assembly located in said cylinder and comprising a piston affixed to an elongated driver, said driver extending through a perforation in said lower cap, said piston/driver assembly being shiftable within said cylinder between a normal retracted position with said piston of said piston/driver assembly at said upper end of said cylinder and an extended fastener driving position, said upper cap having a depression formed in its underside, said depression and said piston of said piston/driver assembly when in its normal position defining a combustion chamber, ignition means in said combustion chamber, a return air chamber in said housing, the lower end of said cylinder being connected to said return air chamber, a source of gaseous fuel under pressure within said housing, a source of gaseous oxidizer under pressure within said housing, and control means to introduce into said combustion chamber a measured amount of gaseous fuel from said source thereof, to introduce into said combustion chamber a measured amount of oxidizer from said source thereof creating an oxidizer-fuel mixture, to actuate said ignition means to combust said oxidizer-fuel mixture in said combustion chamber thereby shifting said piston/-driver assembly from its normal retracted position to its fastener driving position driving a fastener and introducing air under pressure from said cylinder to said return air chamber, and to exhaust spent products of combustion from said combustion chamber and cylinder permitting said piston/driver assembly to return to its normal retracted position under the influence of pressurized air from said return air chamber.

2. The tool claimed in claim 1 including port means in said lower cap connecting said cylinder to atmosphere through a one-way valve means to replenish air beneath said piston/driver assembly upon shifting thereof from its extended fastener driving position to its normal retracted position.

3. The tool claimed in claim 1 wherein said housing includes a handle, a guide body affixed to said housing beneath said cylinder, said guide body having a drive track coaxial with said cylinder, said driver of said piston/driver assembly being shiftable within said drive track, said drive track being configured to guide said driver of said piston/driver assembly and to receive a fastener to be driven by said piston/driver assembly.

4. The fastener driving tool claimed in claim 1 including a magazine, a plurality of fasteners in said magazine, and means to advance said fasteners in said magazine to locate the forwardmost fastener therein beneath said piston/driver assembly at the end of each tool cycle.

5. The fastener driving tool claimed in claim 4 including a plurality of washer-like elements each having a central hole, each of said fasteners being headed and mounted in said central hole of one of said washer-like elements and being supported by its respective washer-like elements, frangible means connecting said washer-like element and forming a strip of said washer-like elements and their respective fasteners, whereby when each fastener is driven into a workpiece it will have its respective washer-like element beneath its head.

6. The fastener driving tool claimed in claim 1 wherein said oxidizer/fuel mixture in said combustion chamber is at a compression ratio of at least about 2:1.

7. The fastener driving tool claimed in claim 1 wherein said oxidizer/fuel mixture in said combustion chamber is at a compression ratio of at least about 3:1.

8. The fastener driving tool claimed in claim 1 including means to adjust the size of said combustion chamber and means to adjust said oxidizer/fuel mixture, whereby to adjust the power of said tool.

9. An internal combustion fastener driving tool comprising a housing, a cylinder located within said housing, said cylinder having lower and upper ends, a lower cap on said housing closing the lower end of said cylinder, an upper cap on said housing closing the upper end of said cylinder, a piston/driver assembly located in said cylinder and comprising a piston affixed to an elongated driver, said driver extending through a perforation in said lower cap, said piston/driver assembly being shiftable within said cylinder between a normal retracted position with said piston of said piston/driver assembly at said upper end of said cylinder and an extended fastener driving position, said upper cap having a depression formed in its underside, said depression and said piston of said piston/driver assembly when in its normal position defining a combustion chamber, ignition means in said combustion chamber, said ignition means comprises a spark plug and a piezoelectric device electrically connected together, said piezoelectric device having an actuating means, a return air chamber in said housing, the lower end of said cylinder being connected to said return air chamber, a source of gaseous fuel under pressure within said housing, said source of gaseous fuel comprising a replaceable fuel canister mounted in said body and containing gaseous fuel under pressure, a first pressure regulating needle valve, said fuel canister being connectable to said first needle valve, a two-way fuel valve, said fuel valve having an inlet connected to said first needle valve and an outlet, a first one-way check valve having an inlet connected to said fuel valve outlet and an outlet connected to said combustion chamber, said fuel valve having an actuating means, a source of gaseous oxidizer under pressure within said housing, said source of gaseous oxidizer comprising a replaceable oxidizer canister mounted in said body and containing said gaseous oxidizer under pressure, a second pressure regulating needle valve, said oxidizer canister being connectable to said second needle valve, a two-way oxidizer valve, said oxidizer valve having an inlet connected to said second needle valve and an outlet, a second one-way check valve having an inlet connected to said oxidizer valve outlet and an outlet connected to said combustion chamber, said oxidizer valve having an actuator means, a pilot-actuated exhaust valve having an inlet connected to said combustion chamber and an outlet connected to atmosphere, a two-way pilot valve for said exhaust valve, said pilot valve having an inlet connected to said return air chamber and an outlet connected to said exhaust valve, said pilot valve having an actuating means, control means to introduce into said combustion chamber a measured amount of gaseous fuel from said source thereof, to introduce into said combustion chamber a measured amount of oxidizer from said source thereof creating an oxidizer-fuel mixture, to actuate said ignition means to combust said oxidizer-fuel mixture in said combustion chamber thereby shifting said piston/driver assembly from its normal retracted position to its fastener driving position driving a fastener and introducing air under pressure from said cylinder to said return air chamber, and to exhaust spent products of combustion from said combustion chamber and cylinder permitting said piston/driver assembly to return to its normal retracted position under the influence of pressurized air from said return air chamber, said control means comprising said fuel valve, said oxidizer valve, said piezoelectric device and said pilot valve together with means to activate said actuators of said fuel valve, oxidizer valve, piezoelectric device and pilot valve in proper timed sequence.

10. The tool claimed in claim 9 wherein said means to activate said actuators of said fuel valve, said oxidizer valve, said piezoelectric device and said pilot valve in proper timed sequence comprises a cam means.

11. The tool claimed in claim 9 wherein said actuators of said fuel valve, said oxidizer valve, said piezoelectric device, and said pilot valve each comprise a stem-like actuator, said means for activating said actuators comprises a cam assembly rotatively mounted within said housing and adjacent said actuators, said cam assembly having a cam element for and contactable by each of said actuators, a trigger, said trigger being manually shiftable between a normal unactuated position and an actuated position, spring means biasing said trigger to said unactuated position, a link means pivotally attached to said trigger and pivotally attached to said cam assembly such that as said trigger is shifted from said unactuated position to said actuated position and back to said unactuated position said cam assembly will make one complete revolution, said cam elements being so configured as to activate their respective actuator in proper timed sequence as said trigger is actuated and released and said cam assembly makes said complete revolution.

12. The tool claimed in claim 11 including port means in said lower cap connecting cylinder to atmosphere through a one-way valve means to replenish air beneath said piston/driver assembly upon shifting thereof from its extended fastener driving position to its normal retracted position.

13. The tool claimed in claim 12 wherein said housing includes a handle, a guide body affixed to said housing beneath said cylinder, said guide body having a drive track coaxial with said cylinder, said driver of said piston/driver assembly being shiftable within said drive track, said drive track being configured to guide said driver of said piston/driver assembly and to receive a fastener to be driven by said piston/driver assembly.

14. The fastener driving tool claimed in claim 13 including a magazine, a plurality of fasteners in said magazine, and means to advance said fasteners in said magazine to locate the forwardmost fastener therein beneath said piston/driver assembly at the end of each tool cycle.

15. The fastener driving tool claimed in claim 14 including means to adjust the size of said combustion chamber and means to adjust said oxidizer-fuel mixture, whereby, to adjust the power of said tool.

16. The fastener driving tool claimed in claim 13 including a magazine, a plurality of fasteners in said magazine and means to advance said fasteners in said magazine to located the forwardmost fastener therein beneath said piston/driver assembly in said drive track at the end of each tool cycle, said forwardmost fastener comprising a stop for said piston/driver assembly positioning said piston/driver assembly upon introduction of said oxidizer/fuel mixture into said combustion chamber to determine the size of said combustion chamber, means to shift said magazine and thus said forwardmost fastener with respect to said tool housing in directions parallel to the longitudinal axis of said piston/-driver assembly to adjust the size of said combustion chamber, said needle valves comprising means to adjust said oxidizer-fuel mixture, whereby the power of said tool can be varied.

17. The fastener driving tool claimed in claim 14 including a plurality of washer-like elements each having a central hole, each of said fasteners being headed and mounted in said central hole of one of said washer-like elements and being supported by its respective washer-like element, frangible means connecting said washer-like elements and forming a strip of said washer-like elements and their respective fasteners, whereby when each fastener is driven into a workpiece it will have its respective washer-like element beneath its head.

18. The tool claimed in claim 9 wherein said actuators of said fuel valve, said oxidizer valve, said piezoelectric device, and said pilot valve each comprises a stem-like actuator, said means for activating said actuators comprising a single cam element rotatively mounted within said housing and adjacent said actuators, said cam element being contactable by each of said actuators, a trigger, said trigger being manually shiftable between a normal unactuated position and an actuated position, spring means biasing said trigger to said unactuated position, a link means pivotally attached to said trigger and pivotally attached to said cam element such that as said trigger is shifted from said unactuated position to said actuated position and back to said unactuated position said cam element will make one complete revolution, said cam element being so configured as to activate each actuator in proper timed sequence as said trigger is actuated and released and said cam element makes said complete revolution.

19. An internal combustion fastener driving tool comprising a housing, a cylinder located within said housing, said cylinder having lower and upper ends, a lower cap on said housing closing the lower end of said cylinder, an upper cap on said housing closing the upper end of said cylinder, a piston/driver assembly located in said cylinder and comprising a piston affixed to an elongated driver, said driver extending through a perforation in said lower cap, said piston/driver assembly being shiftable within said cylinder between a normal retracted position with said piston of said piston/driver assembly at said upper end of said cylinder and an extended fastener driving position, said upper cap having a depression formed in its underside, said depression and said piston of said piston/driver assembly when in its normal position defining a combustion chamber, ignition means in said combustion chamber, said ignition means comprises a spark plug and a piezoelectric device electrically connected together, said piezoelectric device having an actuating means, a return air chamber in said housing, the lower end of said cylinder being connected to said return air chamber, a source of gaseous fuel under pressure within said housing, a source of gaseous fuel comprising a replaceable fuel canister mounted in said body and containing gaseous fuel under pressure, a first pressure regulating needle valve, said fuel canister being connectable to said first needle valve, a two-way fuel valve, said fuel valve having an inlet connected to said first needle valve and an outlet, a first one-way check valve having an inlet connected to said fuel valve outlet and an outlet connected to said combustion chamber, said fuel valve having an actuating means, a source of gaseous oxidizer under pressure within said housing, said source of gaseous oxidizer comprising a replaceable oxidizer canister mounted in said body and containing said gaseous oxidizer under pressure, a second pressure regulating needle valve, said oxidizer canister being connectable to said second needle valve, a two-way oxidizer valve, said oxidizer valve having an inlet connected to said second needle valve and an outlet connected to said one-way check valve inlet, said oxidizer valve having an actuator means, a pilot-actuated exhaust valve having an inlet connected to said combustion chamber and an outlet connected to atmosphere, a two-way pilot valve for said exhaust valve, said pilot valve having an inlet connected to said return air chamber and an outlet connected to said exhaust valve, said pilot valve having an actuating means, control means to introduce into said combustion chamber a measured amount of gaseous fuel from said source thereof, to introduce into said combustion chamber a measured amount of oxidizer from said source thereof creating an oxidizer-fuel mixture, to actuate said ignition means to combust said oxidizer-fuel mixture in said combustion chamber thereby shifting said piston/driver assembly from its normal retracted position to its fastener driving position driving a fastener and introducing air under pressure from said cylinder to said return air chamber, and to exhaust spent products of combustion from said combustion chamber and cylinder permitting said piston/driver assembly to return to its normal retracted position under the influence of pressurized air from said return air chamber, said control means comprising said fuel valve, said oxidizer valve, said piezoelectric device and said pilot valve together with means to activate said actuators of said fuel valve, oxidizer valve, piezoelectric device and pilot valve in proper timed sequence.

20. The tool claimed in claim 19 wherein said actuators of said fuel valve, said oxidizer valve, said piezoelectric device, and said pilot valve each comprise a stem-like actuator, said means for activating said actuators comprises a cam assembly rotatively mounted within said housing and adjacent said actuators, said cam assembly having a cam element for and contactable by each of said actuators, a trigger, said trigger being manually shiftable between a normal unactuated position and an actuated position, spring means biasing said trigger to said unactuated position, a link means pivotally attached to said trigger and pivotally attached to said cam assembly such that a said trigger is shifted from said unactuated position to said actuated position and back to said unactuated position said cam assembly will make one complete revolution, said cam elements being so configured as to activate their respective actuator in proper timed sequence as said trigger is actuated and released and said cam assembly makes said complete revolution.

21. The tool claimed in claim 19 wherein said actuators of said fuel valve, said oxidizer valve, said piezoelectric device, and said pilot valve each comprises a stem-like actuator, said means for activating said actuators comprising a single cam element rotatively mounted within said housing and adjacent said actuators, said cam element being contactable by each of said actuators, a trigger, said trigger being manually shiftable between a normal unactuated position and an actuated position, spring means biasing said trigger to said unactuated position, a link means pivotally attached to said trigger and pivotally attached to said cam element such that as said trigger is shifted from said unactuated position to said actuated position and back to said unactuated position said cam element will make one complete revolution, said cam element being so configured as to activate each actuator in proper timed sequence as said trigger is actuated and released and said cam element makes said complete revolution.

22. An internal combustion fastener driving tool comprising a housing, a cylinder located within said housing, said cylinder having lower and upper ends, a lower cap on said housing closing the lower end of said cylinder, an upper cap on said housing closing the upper end of said cylinder, a piston/driver assembly located in said cylinder and comprising a piston affixed to an elongated driver, said driver extending through a perforation in said lower cap, said piston/driver assembly being shiftable within said cylinder between a normal retracted position with said piston of said piston/driver assembly at said upper end of said cylinder and an extended fastener driving position, said housing including a handle, a guide body affixed to said housing beneath said cylinder, said guide body having a drive track coaxial with said cylinder, said driver of said piston/driver assembly being shiftable within said drive track, said drive track being configured to guide said driver of said piston/-driver assembly and to receive a fastener to be driven by said piston/driver assembly, said upper cap having a depression formed in its underside, said depression and said piston of said piston/driver assembly when in its normal position defining a combustion chamber, ignition means in said combustion chamber, a return air chamber in said housing, the lower end of said cylinder being connected to said return air chamber, a source of gaseous fuel under pressure within said housing, a source of gaseous oxidizer under pressure within said housing, control means to introduce into said combustion chamber a measured amount of gaseous fuel from said source thereof, to introduce into said combustion chamber a measured amount of oxidizer from said source thereof creating an oxidizer-fuel mixture, to actuate said ignition means to combust said oxidizer-fuel mixture in said combustion chamber thereby shifting said piston/driver assembly from its normal retracted position to its fastener driving position driving a fastener and introducing air under pressure from said cylinder to said return air chamber, and to exhaust spent products of combustion from said combustion chamber and cylinder permitting said piston/driver assembly to return to its normal retracted position under the influence of pressurized air from said return air chamber, a magazine, a plurality of fasteners in said magazine and means to advance said fasteners in said magazine to locate the forwardmost fastener therein beneath said piston/driver assembly in said drive track at the end of each tool cycle, said forwardmost fastener comprising a stop for said piston/driver assembly positioning said piston/driver assembly upon introduction of said oxidizer/fuel mixture into said combustion chamber to deteremine the size of said combustion chamber, means to shift said magazine and thus said forwardmost fastener with respect to said tool housing in directions parallel to the longitudinal axis of said piston/driver assembly to adjust the size of said combustion chamber, said needle valves comprisring means to adjust said oxidizer/fuel mixture, whereby the power of said tool can be varied.

23. The fastener driving tool claimed in claim 22 including a plurality of washer-like elements each a central hole, each of said fasteners being headed and mounted in said central hole of one of said washer-like elements and being supported by its respective washer-like element, frangible means connecting said washer-like elements and forming a strip of said washer-like elements and their respective fasteners, whereby when each fastener is driven into a workpiece it will have its respective washer-like element beneath its head.

* * * * *